US008708775B2

(12) United States Patent
Schiller

(10) Patent No.: US 8,708,775 B2
(45) Date of Patent: Apr. 29, 2014

(54) METHOD AND APPARATUS FOR GRINDING A CONTINUOUSLY CASTING PRODUCT

(75) Inventor: Guenter Schiller, Schwindegg (DE)

(73) Assignee: SMS Logistiksysteme GmbH, Netphen (DE)

( * ) Notice: Subject to any disclaimer, the term of this patent is extended or adjusted under 35 U.S.C. 154(b) by 246 days.

(21) Appl. No.: 13/143,577

(22) PCT Filed: Mar. 19, 2010

(86) PCT No.: PCT/EP2010/001729

§ 371 (c)(1),
(2), (4) Date: Sep. 29, 2011

(87) PCT Pub. No.: WO2010/105838

PCT Pub. Date: Sep. 23, 2010

(65) Prior Publication Data

US 2012/0022681 A1 Jan. 26, 2012

(30) Foreign Application Priority Data

Mar. 19, 2009 (DE) ..... 10 2009 013 481

(51) Int. Cl.
*B24B 1/00* (2006.01)

(52) U.S. Cl.
USPC ..... 451/11; 451/58; 451/65; 451/451

(58) Field of Classification Search
CPC ..... B24B 7/075; B24B 55/04
USPC ..... 451/11, 58, 65, 451, 452, 457, 174, 236
See application file for complete search history.

(56) References Cited

U.S. PATENT DOCUMENTS

| | | | | | |
|---|---|---|---|---|---|
| 2,132,640 | A | * | 10/1938 | Mummert | 451/236 |
| 2,423,287 | A | * | 7/1947 | Beisel | 451/93 |
| 2,873,558 | A | * | 2/1959 | Olsen | 451/236 |
| 3,052,067 | A | * | 9/1962 | Dilks | 451/127 |
| 3,081,581 | A | * | 3/1963 | Hensley | 451/236 |

(Continued)

FOREIGN PATENT DOCUMENTS

| | | | |
|---|---|---|---|
| JP | 0053274 | B | 12/1984 |
| JP | 01045561 | B | 2/1989 |
| JP | 2009131950 | B | 6/2009 |

*Primary Examiner* — George Nguyen
(74) *Attorney, Agent, or Firm* — Andrew Wilford

(57) ABSTRACT

The invention relates to a method for grinding a continuous casting product (1), in particular a slab, wherein the continuous casting product (1) in the cross-section has a rectangular contour comprising two long sides (2, 3) disposed opposite of each other and two short sides (4, 5) disposed opposite of each other, wherein in a working position (A), in which the continuous casting product (1) rests on a grinding table (6) with one of the long sides (2) thereof, one of the long sides (2) of the continuous casting product (1) is subjected to a surface treatment by means of at least one grinding tool (7). In order to achieve a higher quality in a simple and fast manner when working the continuous casting product and to be able to collect the grinding chips in a simple manner in the process, after or before grinding the long side (2) of the continuous casting product (1) in the working position (A), according to the invention at least one of the short sides (4, 5) is subjected to a surface treatment using the at least one grinding tool (7). The invention further relates to a device for grinding a continuous casting product (1).

15 Claims, 8 Drawing Sheets

(56) References Cited

U.S. PATENT DOCUMENTS

| | | | | | |
|---|---|---|---|---|---|
| 3,089,287 | A * | 5/1963 | Dilks | 451/127 |
| 3,562,959 | A * | 2/1971 | Dooley, Jr. | 51/139 |
| 3,585,980 | A * | 6/1971 | Mellor | 125/13.01 |
| 3,641,709 | A * | 2/1972 | Gazuit | 451/151 |
| 3,667,165 | A * | 6/1972 | McDowell et al. | 451/127 |
| 3,834,369 | A * | 9/1974 | Haase | 125/13.03 |
| 4,248,019 | A * | 2/1981 | Hawley et al. | 451/137 |
| 4,262,453 | A * | 4/1981 | Parigot et al. | 451/215 |
| 4,283,886 | A * | 8/1981 | Obear | 451/213 |
| 4,501,094 | A | 2/1985 | Veale | |
| 5,980,364 | A * | 11/1999 | Bentley | 451/51 |
| 6,602,120 | B2 * | 8/2003 | Bavelloni | 451/236 |

* cited by examiner

Fig.1 - Prior Art

Fig. 2 - Prior Art

Fig. 3 - Prior Art

METHOD AND APPARATUS FOR GRINDING A CONTINUOUSLY CASTING PRODUCT

CROSS REFERENCE TO RELATED APPLICATIONS

This application is the US-national stage of PCT application PCT/EP2010/001729, filed 19 Mar. 2010, published 23 Sep. 2010 as WO2010/105838, and claiming the priority of German patent application 102009013481.6 itself filed 19 Mar. 2009.

FIELD OF THE INVENTION

The invention relates to a method of grinding a continuously cast workpiece, in particular a slab, where the continuously cast workpiece is of rectangular cross section and has two wide faces disposed opposite each other and two narrow faces disposed opposite each other, and in a working position in which the continuously cast workpiece rests with one of its wide faces on a grinding table one of the wide faces of the continuously cast workpiece is surface treated by at least one grinding tool. The invention further relates to an apparatus for grinding a continuously cast workpiece.

BACKGROUND OF THE INVENTION

Continuously cast workpieces, in particular slabs, are mostly subjected after continuous casting to a surface treatment by grinding so as to achieve a sufficient quality during the subsequent processing of the product. When grinding continuously cast slabs, the slab is usually reciprocated back and forth under a grinder (grinding aggregate) in the longitudinal direction. At the end of each reciprocation, the grinder carries is indexed transversely until the entire slab surface is ground.

During grinding, the slab is mounted on a grinding table and rests on its wide face or broad side.

A generic, known apparatus for grinding slabs is shown in FIGS. 1 to 3. The apparatus is similar to the one described in EP 0 053 274.

In the apparatus according to FIG. 1, so-called HP grinding (High-Pressure Grinding) is carried out. The apparatus has a grinding table 6 and a grinder 21 in the form of a main aggregate with drive motor and grinding wheel 7. In a known manner, the slab 1 has two wide faces 2 and 3 (broad sides) and two narrow faces 4 and 5 (narrow sides). The slab rests with one of its wide faces 3 on the grinding table 6. During grinding of the upper face of the slab, the grinding table 6 is reciprocated under the grinder 21 in a direction perpendicular to the view plane. Here, the grinding wheel 7 is pressed by a grinding pressure cylinder 14' against the upper side of the slab 1. Thus, the slab 1 is reciprocated longitudinally by the grinding table 6 relative to the grinder 21. After each reciprocation, the grinder 21 is indexed transversely by a feed cylinder 22 until the entire upper side of the slab is finish-ground.

Depending on quality requirements it is necessary here to grind not only the wide slab faces 2 and 3 but also the narrow slab faces 4 and 5. Therefore, in addition to the grinder 21, that is the main aggregate, for grinding the wide faces 2 and 3 of the slab 1, there is a second grinder 23 in the form of an auxiliary aggregate intended to grind the narrow faces 4 and 5 of the slab 1. Here too, a grinding wheel 7 is provided.

After the upper wide face 2 of the slab has been ground by the main aggregate 21, a narrow face 5 of the slab 1 is ground by the auxiliary aggregate 23.

FIGS. 2 and 3 respectively illustrate the main aggregate 21 and the auxiliary aggregate 23, the movement of the grinding wheel 7 during grinding, i.e. the feed by the aggregates 21, 23 being indicated insofar that the grinding wheel and its spindle is shown in each case in two different positions. The expenditures associated with the additional installation of an auxiliary aggregate are relatively high.

Moreover, one problem is that severe caking of grinding chips on the apparatus can occur if the path of flying chips cannot be optimized. Thus, in case of the known solutions, high maintenance expenditures are required.

OBJECT OF THE INVENTION

Therefore, it is the object of the invention to provide a method and an associated apparatus that allow one to ensure a high manufacturing quality when machining the continuous continuously cast workpiece, but where, however, the high expenditures arising in the above-discussed prior art due to providing the apparatus is with main and auxiliary grinders are eliminated. Another object is to grind the continuously cast workpiece in an efficient and fast manner so that the grinding operation can be carried out economically. Furthermore, the method and the apparatus should remove the grinding chips in an improved manner. Here, it is particularly intended to reduce caking of chips on the apparatus.

SUMMARY OF THE INVENTION

The solution according to invention of the object is characterized in that after or before grinding the wide face of the continuously cast workpiece in the working position with the grinding tool, at least one of the narrow faces is surface treated.

In addition to the wide face, preferably only one of the narrow faces is surface treated in an ongoing grinding process. The rotational direction of the grinding tool is particularly the same during the surface treatment of the long and the narrow faces. This results in an optimized chip transport. The reason for this is that the rotational direction of the grinding tool during the surface treatment of the long and the narrow faces is advantageously selected in such a manner that the path of flying chips during the surface treatment is oriented horizontally to the side or vertically downward.

The wide face of the continuously cast workpiece is mostly at least twice as large as the narrow face of the continuously cast workpiece and in case of slabs is a multiple of the width of the narrow faces.

The apparatus for grinding a continuously cast workpiece has a grinder with at least one grinding tool for grinding at least one wide face of the continuously cast workpiece, the grinder comprising a holding arm pivotal about an axis on a support element of the grinder, the grinding tool being mounted at a location on the holding arm that is spaced apart from the pivot axis, and for pivoting the holding arm relative to the support element an actuator is operatively arranged between the support element and the holding arm. The invention provides here that the actuator consists of two subactuators connected in series.

One of the subactuators is configured with respect to its adjustment travel and/or actuating force as steplessly controllable with or without feedback, the other subactuator being configured as an element that can only be positioned in two end positions.

At least one of the subactuators, preferably both subactuators, are preferably hydraulic or pneumatic piston-cylinder systems.

The grinding tool is preferably mounted at an end of the holding arm remote from the pivot axis. Advantageously, the actuator acts close to the grinding tool on the holding arm.

The grinding tool can be covered over a portion of its circumference by a protective hood that hood is mounted to be rotatable about a rotational axis that is parallel to the rotational axis of the grinding tool. An actuator is braced between a circumferential point of the protective hood and the holding arm. This actuator is preferably configured as pneumatic or hydraulic piston-cylinder system. The protective hood can be mounted on a pivot arm that is mounted on the holding arm and can be pivoted about a pivot axis parallel to the rotational axis of the grinding tool and spaced therefrom. It can be provided here that an actuator for pivoting the pivot arm relative to the holding arm is operatively mounted between the pivot arm and the holding arm, which simplifies the grinding wheel change.

With the proposal according to the invention, high product quality can be achieved, but a separate grinder, i.e. the auxiliary aggregate for grinding the narrow face, can be eliminated.

The single grinder provided in the proposed solution has thus been modified in such a manner that it is also suitable for grinding the narrow face of the continuously cast workpiece. It has to be ensured here that the cylinder stroke of the grinding pressure cylinder is significantly larger than is the case in the known apparatus because due to the radius of the worn grinding wheel and the product thickness, the grinding wheel has to be positioned lower in a corresponding manner so as to be able to grind the narrow face (narrow side) completely.

However, simply increasing the stroke of a single piston-cylinder system would influence the control behavior of the grinder in a very negative manner due to the increasing oil column in the cylinder. This way, operationally reliable grinding would no longer be ensured. To solve this problem, the apparatus according to the invention provides two subactuators that are connected in series, only one of which serves for controlling the pressing force; the other is a pure positioning actuator that only has to assume two end positions.

Furthermore, the protective hood of the grinding wheel has been suitably modified so that the hood does touch the wide face when grinding the narrow face.

Thus, with the proposed apparatus and approach it is possible to grind a wide face as well as a narrow face in an efficient and fast as well as precise manner. Therefore, a separate auxiliary aggregate can be eliminated without compromising the quality.

For grinding a slab, it is mounted on the grinding table lying horizontally on one of its wide faces (broad sides). First, the wide face is ground in the usual manner. After this (or before this), the narrow face (narrow side) is ground on the side. An advantage is that the direction of flight of the chips does not change if the rotational direction of the grinding wheel is maintained and only one chip collection box needs to be installed. The chip collection box has to be extended only up to the grinding table. The rotational direction does not change during machining.

BRIEF DESCRIPTION OF THE DRAWING

The drawing illustrates embodiments of the invention with a slab as continuously cast workpiece. Therein.

SPECIFIC DESCRIPTION OF THE INVENTION

Figure 4:
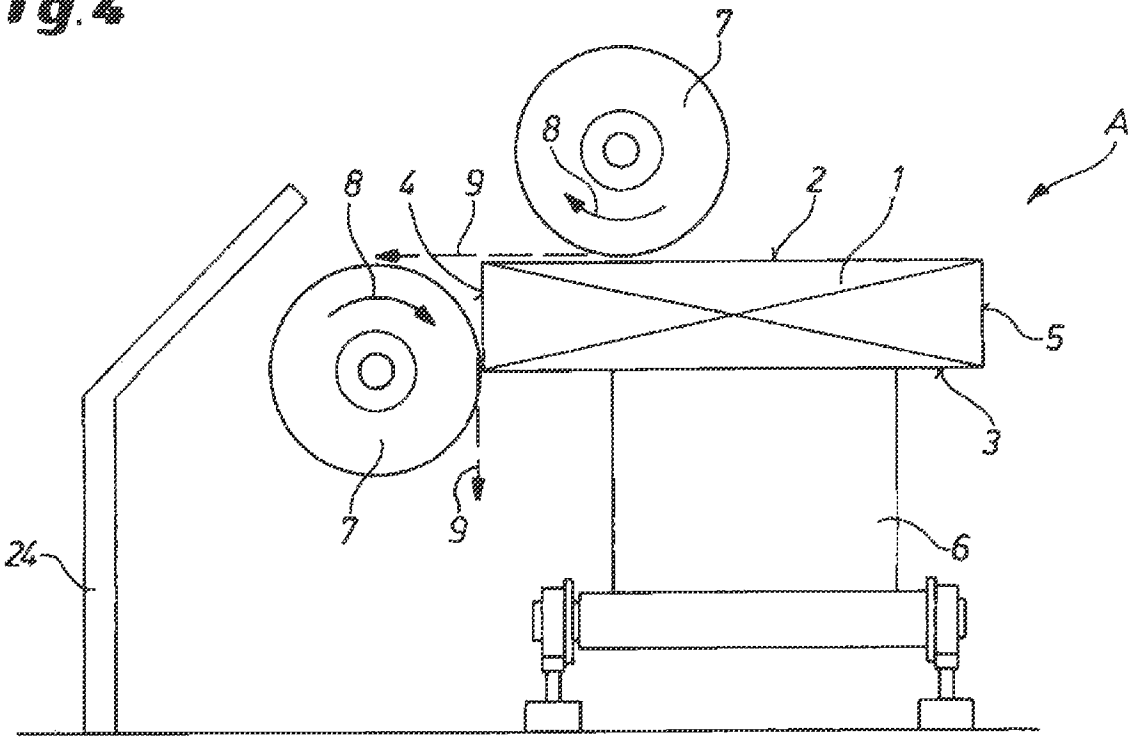
FIG. 4 schematically shows the grinding of a continuously cast workpiece with the method according to the invention.

FIG. 4 schematically illustrates an apparatus for grinding a slab 1 that works according to the invention. The slab is of rectangular cross-section as shown in FIG. 4; the slab 1 extends with its longitudinal axis in a direction perpendicular to the drawing plane. Accordingly, the slab 1 has two wide faces 2 and 3 (broad sides) and two narrow faces 4 and 5 (narrow sides).

The slab 1 rests with its lower wide face 3 on a grinding table 6. This working position of the slab 1 is designated by A. During the method according to the invention, the slab 1 remains in this working position A. After the method is carried out, the slab is turned by 180° about its longitudinal axis and the method is repeated.

The slab surface is machined here by grinding in order to be able to make a finished product with sufficient quality from the slab. To this end, a grinder is provided of which only the grinding wheel 7 is shown in FIG. 4. Arrow 8 indicates the rotational direction of the grinding tool (grinding wheel) 7 during its operation.

First, the grinding wheel 7 is moved in a known manner horizontally transverse to the longitudinal axis of the slab in order to grind the upper wide face 2. It is essential that after (or, if needed also before) grinding the wide face 2 of the slab 1 in the working position A, one of the narrow faces 4 is subjected in a continuously progressing work process to a surface treatment using the same grinding wheel 7.

Grinding is carried out in a manner known per se, i.e. the grinding table 6 reciprocates back and forth parallel to the longitudinal axis of the slab 1 (i.e. perpendicular to the view plane) while with each reciprocation of the grinding table 6, the grinding wheel 7 is stepped transversely parallel to the width direction of the slab 1.

The rotational direction 8 of the grinding wheel 7 projects the grinding chips horizontally (to the left) on the slab surface during grinding the wide face 2, as indicated by the path 9 of the flying chips. During grinding the narrow face 4, however, the chips are projected downward (chip path 9) where an unillustrated chip collection box is located. The flying chips can be deflected by a baffle plate 24.

In the embodiment according to the FIGS. 5 to 8, a grinder 10 is modified in such a manner that grinding the upper wide face 2 as well as grinding the left narrow face 4 is possible. Thus, a separate auxiliary aggregate can be eliminated. To this end, both movement directions of the grinder are equipped with a grinding pressure control.

Figure 1:
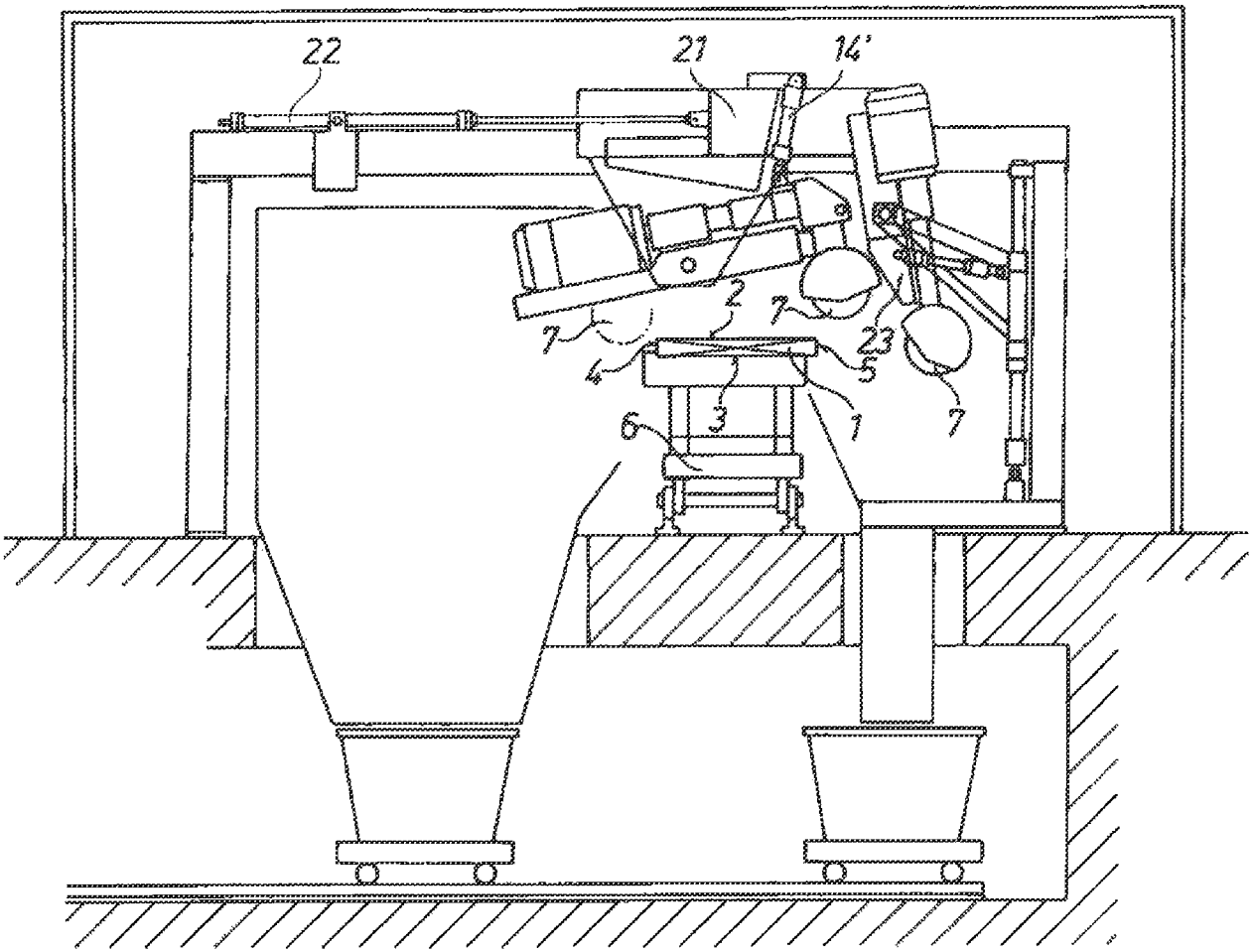
FIG. 1 shows an apparatus for grinding a continuously cast workpiece in the form of a slab according to the prior art.
Figure 2:
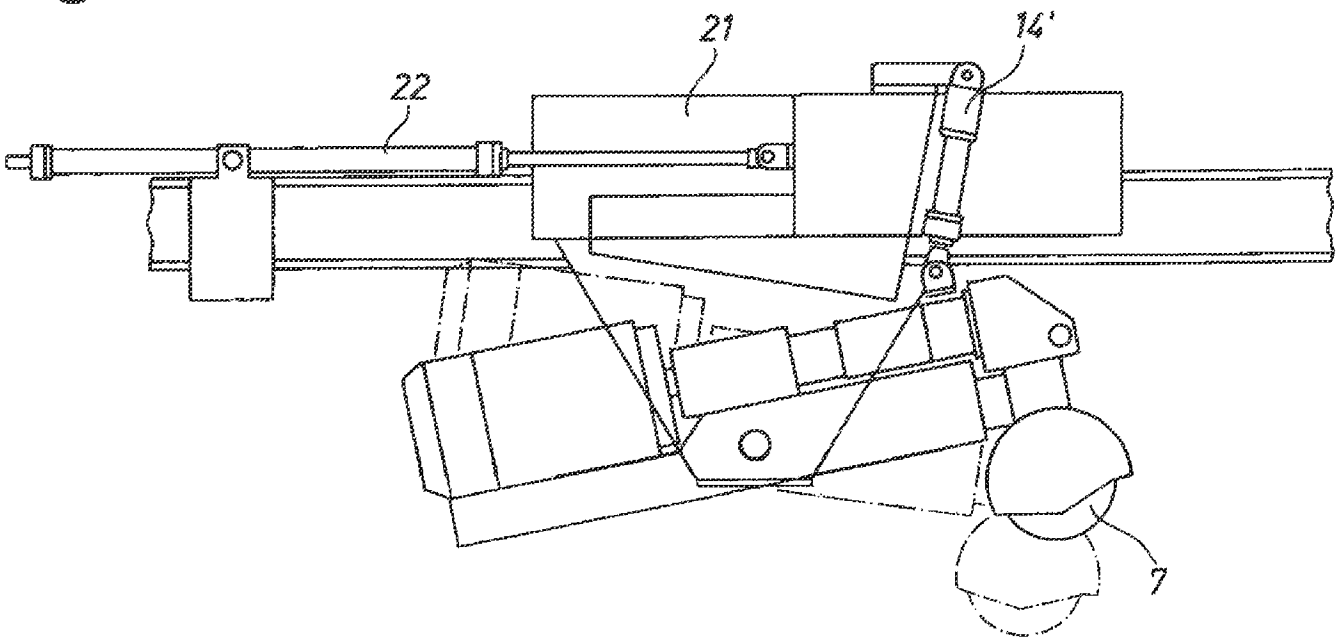
FIG. 2 shows the main grinder of the prior-art apparatus according to FIG. 1.
Figure 3:
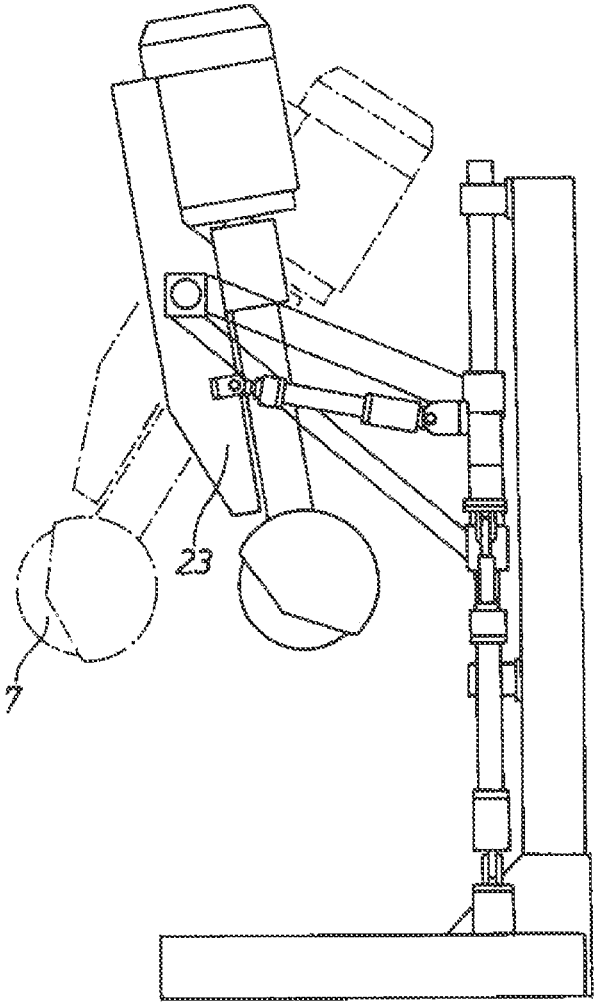
FIG. 3 shows the auxiliary grinder of the prior-art apparatus according to FIG. 1.
Figure 5:
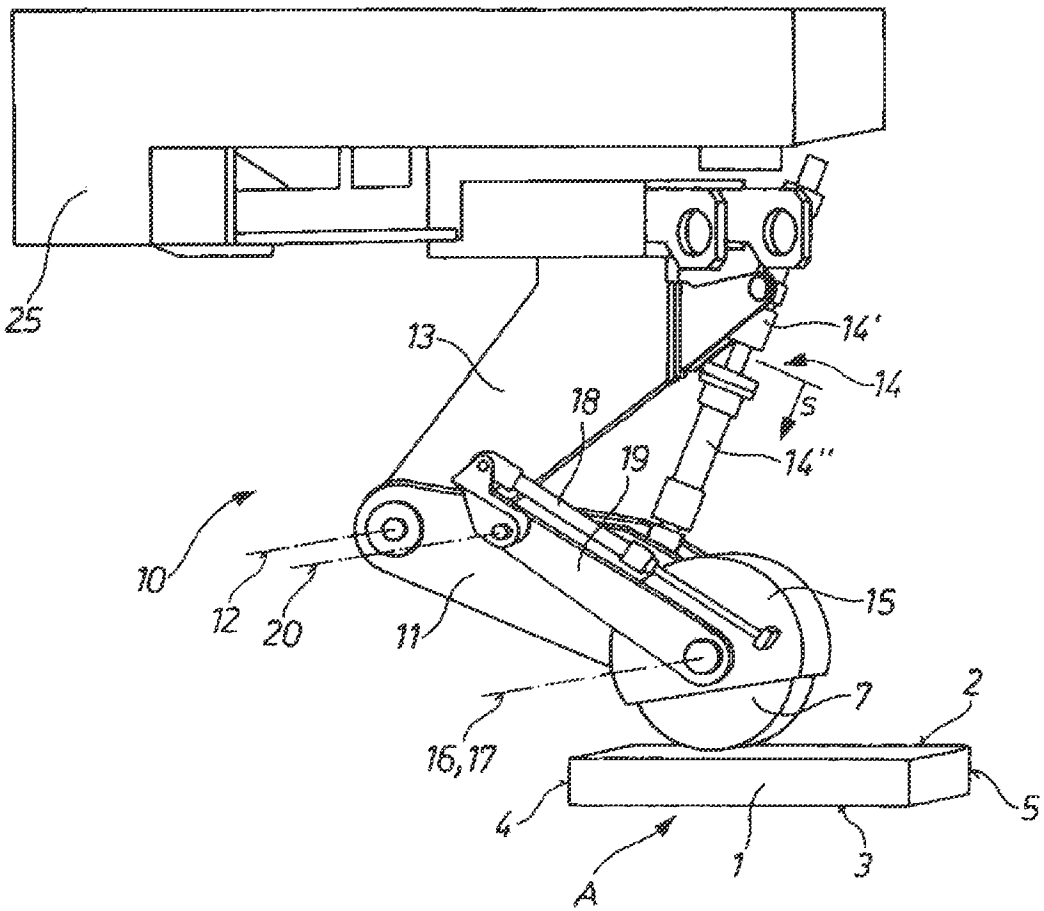
FIG. 5 is a perspective view of a grinder according to the invention while grinding the upper wide face of the slab.

The grinder 10 according to FIG. 5 allows such a grinding process. A support element 13 is fixed to a base frame 25 that can be moved according to FIG. 1 by the feed cylinder 22. The support element 13 has a pivot axis 12 at which a holding arm 11 is hinged so that it can be pivoted relative to the support element 13 about the axis 12. The holding arm 11 carries at its end a spindle with the grinding wheel 7 that rotates about its axis 17.

For feeding the grinding wheel 7 as well as for applying a defined pressing force, an actuator 14 is braced between the support element 13 and the holding arm 11.

It is essential that the actuator 14 consists of two subactuators 14' and 14" that are connected in series. The subactuator 14' corresponds to the usual grinding pressure cylinder with the usual stroke as also provided in the prior art according to FIG. 1 and designated by the reference number 14'. It performs a defined adjustment travel s (see FIG. 5). However, the second subactuator 14" is an actuator that is not steplessly controllable but is an actuator that can only be moved between two positions and can be retained therein.

The first position that the subactuator 14" assumes is shown in FIG. 5 and is selected if a wide face 2 of the slab 1 is to be ground.

Figure 6:
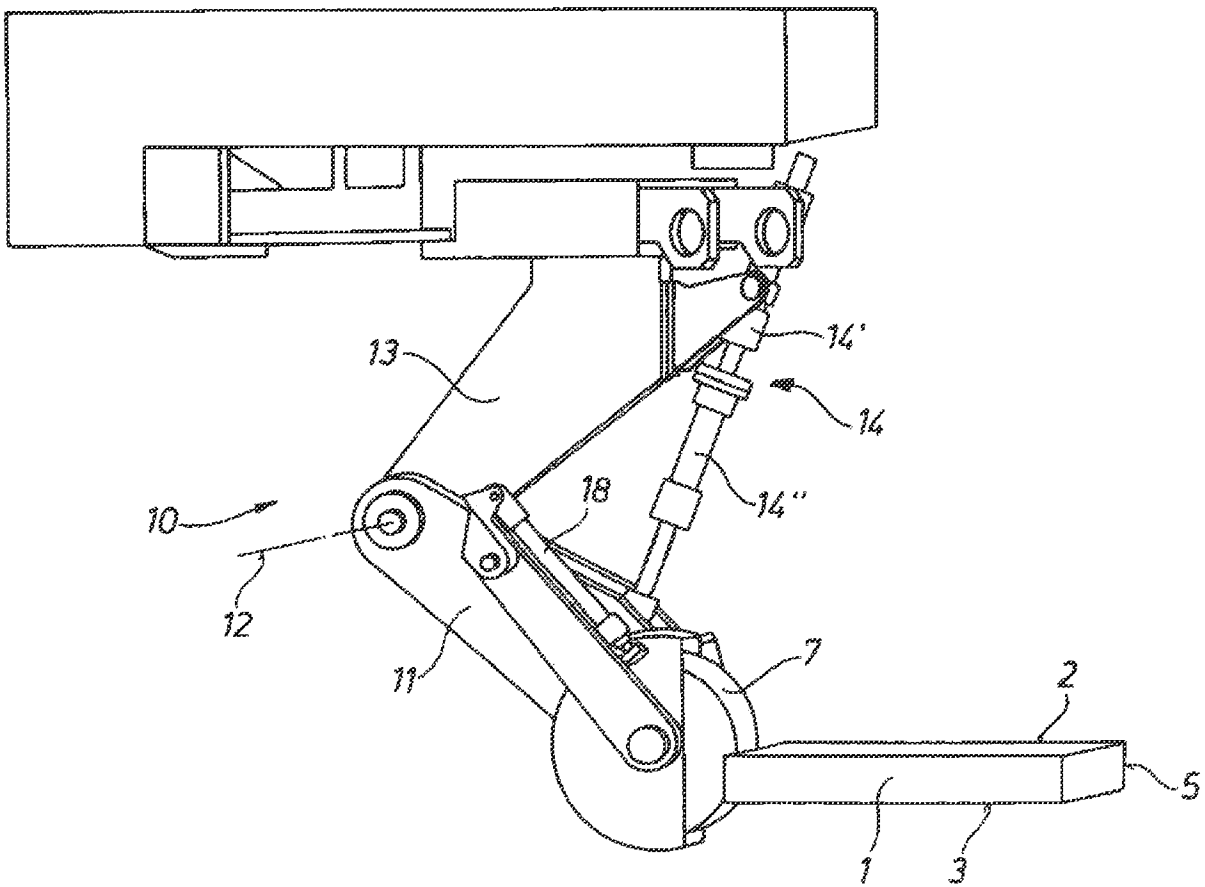
FIG. 6 shows the apparatus according to FIG. 5 when grinding a narrow face of the slab.

The other position assumed by the subactuator 14" is illustrated in FIG. 6 and is used if the narrow face 4 of the slab 1 is to be ground. In order to keep the stroke of the steplessly controllable grinding pressure cylinder (subactuator 14') short, the second subactuator 14 connected in series with the latter, which second subactuator has only two positions: piston completely retracted for grinding the wide face 2 and piston completely extended for grinding the narrow face 4.

The second subactuator 14" is pressurized in its end positions with the maximum operating pressure so that the subactuator has the property of a rigid spacer.

As further shown in the FIGS. 5 to 8, the grinding wheel 7 is partially covered by a protective hood 15, namely over a portion of its circumference. The protective hood 15 is rotatably mounted about a rotational axis 16 that is parallel to the rotational axis 17 of the grinding wheel 7.

At a point on the protective hood 15 radially offset from its pivot axis 16, an actuator 18 is engaged that is pivoted at its other end to the holding arm 11. Accordingly, by extending or retracting the actuator 18, the protective hood 15 can be rotated. In the position according to FIG. 5, the hood is positioned for grinding the wide face 2. If the narrow face 4 is ground as shown in FIG. 6, the protective hood is brought into a retracted position so that no contact between protective hood 15 and slab 1 can take place.

Thus, the protective hood 15 is rotatably mounted in such a manner that it can be suitably rotated for grinding the main or auxiliary sides.

The protective hood 15 is mounted at one end of a pivot arm 19 that is pivoted at its other end on the holding arm 11. Thus, the protective hood 15 and the pivot arm 19 can be pivoted about a pivot axis 20 that is parallel to the rotational axis 17 of the grinding wheel 7. This is utilized for the grinding wheel change.

Figure 7:
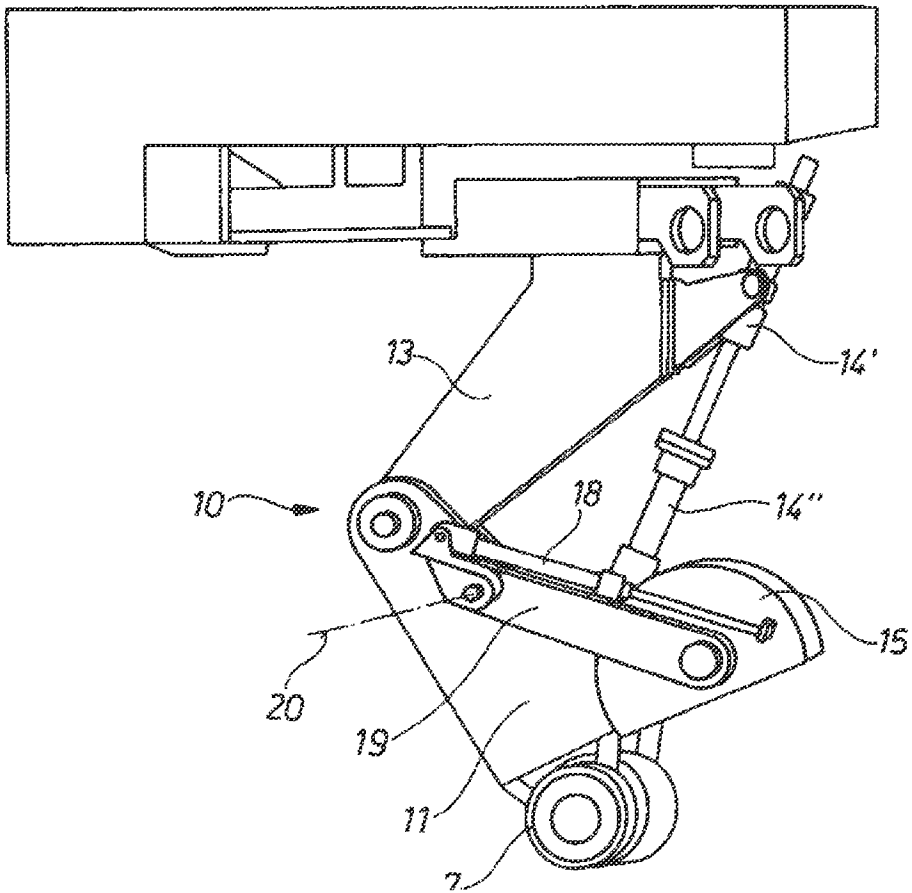
FIG. 7 shows the apparatus according to FIG. 5 with a worn grinding wheel immediately before changing the wheel.
Figure 8:
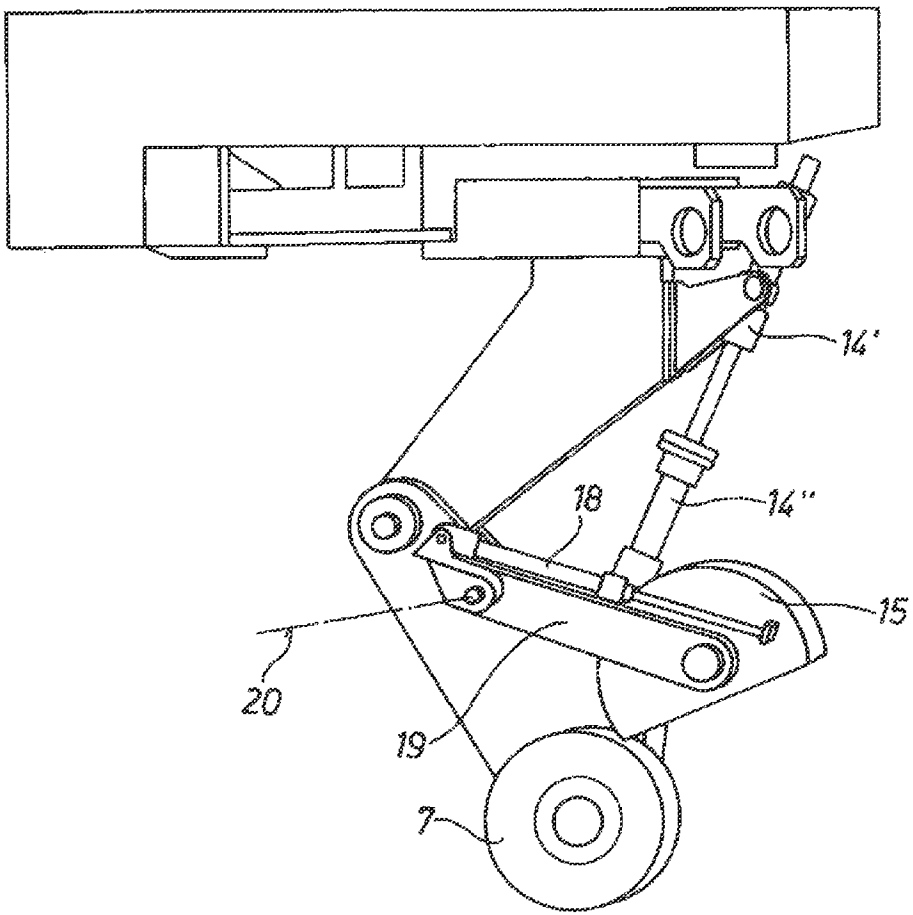
FIG. 8 shows the apparatus as in FIG. 7, but with a fresh grinding wheel.

For the grinding wheel change that is shown in the FIGS. 7 and 8, the protective hood 15 can be pivoted by hand or via an actuator (not illustrated) into the uppermost position. The worn grinding wheel 7 is freely accessible and can be replaced according to FIG. 7 with a new grinding wheel 7 according to FIG. 8.

As already mentioned, the feed cylinder 22 is used for horizontal advance of the grinding wheel 7. When the feed cylinder 22 pushes the grinder 10 for example toward the slab 1, the grinding wheel 7 is pulled by the actuator 14 via the pivot axis 12 into a lower position and against the narrow face 4.

The slab 1 that is machined in this manner can involve a hot slab.

Since ultimately only the relative movement between slab and grinding wheel is of importance, as an alternative the slab is carried on a stationary support and the grinder 10 moves parallel to the longitudinal axis of the slab.

The invention claimed is:

1. A method of grinding an elongated continuously cast slab workpiece of rectangular section having a pair of generally planar, parallel, and opposite wide faces and a pair of generally planar, parallel, and opposite narrow edge faces, the method comprising the steps of sequentially:

a) orienting the workpiece in a working position on a support with one of the wide faces directed upward, the workpiece extending along a horizontal longitudinal axis, and the narrow edge faces directed horizontally;

a') providing a hood shield around at least 180° of the grinding wheel;

b) with the workpiece in the working position and while rotating the wheel about a wheel axis substantially parallel to the longitudinal axis, simultaneously engaging a grinding tool with the one wide face while relatively longitudinally reciprocating the tool and workpiece while transversely indexing the tool and workpiece after each reciprocation to surface treat the one wide face;

c) with the workpiece in the working position and while rotating the wheel about a wheel axis substantially parallel to the longitudinal axis, reorienting the tool adjacent one of the narrow edge faces and thereafter simultaneously engaging the grinding tool with the one narrow edge face while relatively longitudinally relatively displacing the tool and the workpiece to surface treat the one edge face; and reorienting the hood shield by about 90° between steps b) and c) to prevent contact of the shield with the workpiece.

2. The method according to claim 1, wherein a rotation direction of the grinding tool during grinding of the wide and narrow faces is kept the same.

3. The method according to claim 1, wherein a rotation direction of the grinding tool during grinding of the wide and narrow faces is selected such that flying chips generated by the grinding are projected horizontally to the side or vertically downward.

4. The method according to claim 1, wherein the wide faces of the continuously cast workpiece are at least twice as wide as the narrow faces of the continuously cast workpiece.

5. An apparatus for grinding a continuously cast workpiece of rectangular cross section and having two wide faces disposed opposite each other and two narrow faces disposed opposite each other, the apparatus comprising:

a table adapted to support the workpiece in a working position with one of the wide faces directed upward and the edge faces directed horizontally;

a support element adjacent the table, the support element and the table being relatively displaceable;

a holding arm pivoted about an axis on the support element' a tool carried on the arm at a spacing from the axis; and two subactuators connected in series to form an actuator extending between the support element and the arm for pivoting the arm relative to the support element relative to the workpiece in the working position between a position with the tool engaging the one wide face and a position engaging one of the narrow faces.

6. The apparatus according to claim 5, wherein one of the subactuators is configured with respect to its adjustment travel and/or its actuating force as a steplessly controllable element, and the other subactuator is configured as an element that can only be held in two end positions.

7. The apparatus according to claim 5, wherein at least one of the subactuators is a hydraulic or pneumatic piston-cylinder system.

8. The apparatus according to claim 5, wherein the grinding tool is mounted at an end of the holding arm that is remote from the pivot axis.

9. The apparatus according to claim 5, wherein the actuator is pivoted close to the grinding tool on the holding arm.

10. The apparatus according to claim 5, further comprising:

a protective hood covering the grinding tool over a portion of its circumference and rotatable about a rotation axis parallel to a rotation axis of the grinding tool.

11. The apparatus according to claim 10, further comprising:

an actuator braced between a point of the protective hood offset from the rotation axis of the hood and the holding arm.

12. The apparatus according to claim 11, wherein the actuator of the hood is a pneumatic or hydraulic piston-cylinder system.

13. The apparatus according to claim 10, further comprising:

a pivot arm carrying the protective hood, pivotal on the holding arm about a pivot axis that is parallel to the rotational axis of the grinding tool and spaced therefrom.

14. The apparatus according to claim 13, further comprising:

an actuator for pivoting the pivot arm relative to the holding arm and operatively mounted between the pivot arm and the holding arm.

15. The method defined in claim 1 wherein the wheel projects particles tangentially of the wheel axis, the method comprising the steps of:

intercepting and trapping the projected particles.

* * * * *